United States Patent [19]

Parlman et al.

[11] Patent Number: 4,462,898

[45] Date of Patent: Jul. 31, 1984

[54] ORE FLOTATION WITH COMBINED COLLECTORS

[75] Inventors: Robert M. Parlman; Clarence R. Bresson, both of Bartlesville, Okla.

[73] Assignee: Phillips Petroleum Company, Bartlesville, Okla.

[21] Appl. No.: 409,254

[22] Filed: Aug. 18, 1982

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,833,740 | 11/1931 | Derby et al. | 209/166 |
| 2,430,778 | 11/1947 | Moyer | 209/167 |
| 3,086,653 | 4/1963 | Booth | 209/167 |
| 4,040,950 | 8/1977 | Zippian et al. | 209/166 |

FOREIGN PATENT DOCUMENTS

| | | | |
|---|---|---|---|
| 6916 | of 1927 | Australia | 209/167 |
| 11121 | 2/1934 | Australia | 209/166 |
| 159133 | 9/1954 | Australia | 209/167 |

*Primary Examiner*—Bernard Nozick

[57] ABSTRACT

Sodium diethyl dithiophosphate and sodium ethyl trithiocarbonate are used for the flotation of molybdenum and/or copper containing ores.

S-allyl-S'-n-butyl trithiocarbonate and N,N-dimethyl-S-benzyl dithiocarbamate are used for the flotation of molybdenum and/or copper containing ores.

Sodium isopropyl xanthate and sodium n-butyl trithiocarbonate are used for the flotation of lead.

1 Claim, No Drawings

ORE FLOTATION WITH COMBINED COLLECTORS

This invention relates to mineral recovery by flotation operations. More specifically the invention relates to a new composition comprising two flotation ingredients. Another aspect of this invention relates to ore flotation processes, particularly those involving the recovery of lead and zinc, or molybdenum and copper.

BACKGROUND OF THE INVENTION

Flotation processes are known in the art and are used for recovering and concentrating minerals from ores. In froth flotation processes the ore is crushed and wet ground to obtain a pulp. Additives such as mineral flotation or collecting agents, frothers, suppressants, stabilizers, etc. are added to the pulp to assist separating valuable materials from the undesired minerals or gangue portions of the ore in subsequent flotation steps. The pulp is then aerated to produce a froth at the surface. The minerals which adhere to the bubbles or froth are skimmed or otherwise removed and the mineral bearing froth is collected and further processed to obtain the desired minerals. Typical mineral flotation collectors include xanthates, amines, alkyl sulfates, arene sulfonates, dithiocarbamates, dithiophosphates and thiols.

U.S. Pat. No. 2,600,731 describes alkali metal salts of tertiary alkyl trithiocarbonates and processes to make same. The patent also describes the use of these compounds in ore flotation. Sodium diethyl dithiophosphate has also been described in other references as a collector in the separation of zinc and copper. The prior art has also described potassium ethyl xanthate and potassium isoamyl xanthate as ore flotation collectors for copper.

While the art of ore flotation has reached a significant degree of sophistication it is a continuing goal in the ore recovery industry to increase the productivity of ore flotation processes and above all to provide specific processes which are selective to one ore or to one metal over other ores or other metals, respectively, which are present in the treated material.

THE INVENTION

It is thus one object of this invention to provide a new composition which is useful in ore flotation.

Another object of this invention is to provide a flotation process.

A further object of this invention is to provide an improved flotation process using the new compositions to improve the recovery of molybdenum and copper.

A still further object of this invention is to provide a flotation process utilizing the new compositions wherein the recovery of lead is improved.

These and other objects, advantages, details, features and embodiments of this invention will become apparent to those skilled in the art from the following detailed description of the invention and the appended claims.

In accordance with this invention it has been found that the recovery of molybdenum and copper is synergistically improved when sodium ethyl trithiocarbonate and sodium diethyl dithiophospate are used together in a flotation process.

Also in accordance with this invention it has been discovered that lead recovery is synergistically improved when sodium isopropyl xanthate and sodium n-butyl trithiocarbonate were used in combination as a flotation agent in lead recovery.

Thirdly, it has been discovered that in the recovery of molybdenum and copper the combination of S-allyl-S'-n-butyl trithiocarbonate and N,N-dimethyl-S-benzyl dithiocarbamate results in a synergistic effect.

Thus, in accordance with a first embodiment of this invention novel ore flotation compositions are provided. These novel ore flotation compositions are as follows:

(1) The DTP/TTC composition useful for molybdenum and copper recovery contains the following compounds in substantial quantities:
  (a) sodium diethyl dithiophosphate
  (b) sodium ethyl trithiocarbonate (2) The IPX/TTC composition useful for lead recovery contains both of the following compounds in substantial quantities:
  (a) sodium isopropyl xanthate
  (b) sodium n-butyl trithiocarbonate (3) The TTC/DTC composition for molybdenum and copper recovery contains the following two compounds in substantial quantities:
  (a) S-allyl-S'-n-butyl trithiocarbonate
  (b) N,N-dimethyl-S-benzyl dithiocarbamate.

The compositions mentioned above have the following structural formulae:

sodium diethyl dithiophosphate

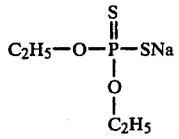

sodium ethyl trithiocarbonate

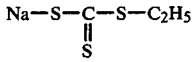

sodium isopropyl xanthate

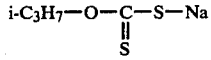

sodium n-butyl trithiocarbonate

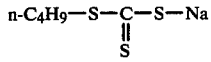

S-allyl-S'-n-butyl trithiocarbonate

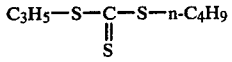

N,N-dimethyl-S-benzyl dithiocarbamate

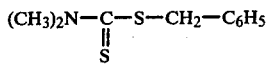

The two synergistically acting components for all three ore flotation compositions are preferably present in the composition in weight ratios in the range of 1:9 to 9:1, preferably 40:60 to 60:40. Most preferably the two ingredients (a) and (b) of the above-defined compositions are present in the flotation agent in roughly the same quantity by weight.

The preferred ore DTP/TTC and IPX/TTC flotation compositions are aqueous compositions containing the above-identified chemicals. Water is present in these compositions in a quantity so that 5 to 50 parts by weight of each of the composition (a) and (b) is present per 100 parts by weight of water.

The preferred TTC/DTC ore flotation composition is an oily composition consisting essentially of the two compounds defined above.

In a yet further preferred embodiment of this invention the composition used in the ore flotation process contains in addition to the two compounds (a) and (b), which, as will be shown, act synergistically in certain ore flotation applications, a frother. Examples of such frothers are methyl isobutylcarbinol, polypropylene glycol in a preferred molecular weight range of about 400 to about 900, polybutylene glycol and polypentylene glycol. Generally speaking, polyoxyalkylene glycols and the corresponding ethers can be used as frothers in the compositions of this invention and the molecular weight of such frothers can be broadly in the range of 400 to about 1000, preferably in the range of about 420 to about 780. The frothing agent or frother will be employed in quantities that are conventional in this art. Usually the ratio of the weight of the collector (the weight for the composition (a) and (b)) to the weight of the frothing agent will be in the range of 10:90 and 90:10 and preferably 35:65 to 65:35.

The chemical compositions involved in this invention, namely sodium diethyl dithiophosphate
sodium ethyl trithiocarbonate
sodium isopropyl xanthate
sodium n-butyl trithiocarbonate
S-allyl-S'-n-butyl trithiocarbonate
N,N-dimethyl-S-benzyl dithiocarbamate most of which are commercially available products. The production of the unsymmetrical S-allyl-S'-n-butyl trithiocarbonate is described in detail in the Belgium Pat. No. 890,634.

Specifically the individual compounds which are commercially available are listed in the following under their tradenames:

| Chemical Compound | Tradename, Company |
|---|---|
| sodium diethyl dithiophosphate | Aerofloat, American Cyanamid Co. |
| sodium isopropyl xanthate | Aerofloat 343, American Cyanamid Co.<br>Z-11, Dow Chemical |
| sodium n-butyl trithiocarbonate | ORFOM C 0800, Phillips Petroleum Co. |
| S—allyl-S'—n-butyl trithiocarbonate | ORFOM C 0300, Phillips Petroleum Co. |

FLOTATION PROCESS

In accordance with another embodiment of this invention a flotation process is provided. This flotation process involves the steps of (a) mixing the mineral material with water and the composition defined above to establish a pulp,
(b) aerating the pulp to produce a froth and a tail product,
(c) separating the froth and the tail product and
(d) recovering minerals from the separated froth and/or tail product.

The process steps here involved are conventional except for the novel composition used as collector and optionally frother in combination as defined above. Although the two compounds (a) and (b) as defined above and—when used—the frother can be added separately during the froth flotation operation, it is preferred that all (a) and (b) be premixed, blended or otherwise combined before using. The amount of collector blend (weight of compound (a) and (b) together) is generally in the range 0.005 to 0.5 lb/ton of ore, and preferably in the range of 0.01 to 0.2 lb/ton of ore.

As pointed out above, the three different compositions which have been found to exhibit synergistic recovery as compared to the individual compounds present in the composition are particularly useful for the ores described above. The compositions are particularly useful for recoverying minerals values from molybdenum/copper ores or respectively lead ores that have been sulfided.

Examples of molybdenum containing ores are:

| | |
|---|---|
| Molybdenite | $MoS_2$ |
| Wulfenite | $PbMoO_4$ |
| Powellite | $Ca(Mo,W)O_4$ |
| Ferrimolybdite | $Fe_2Mo_3O_{12}.8H_2O$ |

Examples of copper containing ores are:

| | | | |
|---|---|---|---|
| Covallite | $CuS$ | Bornite | $Cu_5FeS_4$ |
| Chalcocite | $Cu_2S$ | Cubanite | $Cu_2SFe_4S_5$ |
| Chalcopyrite | $CuFeS_2$ | Valerite | $Cu_2Fe_4S_7$ |

An example of lead containing ores is:

Galena Pbs

The following examples serve to further illustrate the invention as well as to show further preferred embodiments thereof without undue limitation to its scope.

The sodium n-alkyl trithiocarbonate salts described and used herein were prepared as a 40 wt. % aqueous reaction product mixture by adding in near stoichiometric amounts n-alkyl mercaptan (i.e. n-butyl mercaptan or ethyl mercaptan) to aqueous sodium hydroxide, stirring at room temperature for a few minutes after which a stoichiometric amount of carbon disulfide is slowly added with stirring. The aqueous solution is used directly as prepared with no further separation or purification.

EXAMPLE I

This example is a control describing a standard ore flotation process which is used herein to evaluate various type collectors. To a ball mill was charged 1300 grams of a lead/zinc-containing ore from Hecla Star mine along with 560 milliliters water and the slurry ground for 10 minutes 45 seconds to a Tyler screen mesh size of 22% +100. The mixture was transferred to a 2.5 liter Denver D-12 flotation cell along with enough water to make a 38 to 40% solids solution. About 8.8 grams of soda ash were added to adjust the pH to 8.8. In addition there was added 0.04 lb/ton NaCN (1% aqueous solution) and 0.5 lb/ton $ZnSO_4$ (10% aqueous solution) as a zinc suppressant along with 0.1 lb/ton sodium isopropyl xanthate (Z-11, 1% aqueous) as a Pb collector and 0.03 lb/ton methyl isobutylcarbinol (MIBC) as a frother. The mixture was conditioned for 20 seconds with stirring at 1000 rpm. The float was started by introducing air through the agitator (about 42 cubic feet per minute). The concentrate was regularly scraped off with a paddle for a total float time of 4.5 minutes. Air was stopped and about 4.1 grams of soda ash was added to adjust the pH to 10.5. Also added to the cell was 0.6 lb/ton $CuSO_4$ (10% aqueous solution) as a zinc activator along with 0.2 lb/ton Z-11 collector and 0.08 lb/ton frother (a 2:1 weight ratio mixture of MIBC and AF-65, a polypropylene glycol, molecular weight ~450). After a 20 second conditioning, the slurry was floated for 5.5 minutes. The first and second floats were combined, dried and analyzed. The results are listed in Table I and serve as control values.

TABLE I

| Sodium Isopropyl Xanthate as a Collector For Pb and Zn | | | | | | | | |
|---|---|---|---|---|---|---|---|---|
| | First Float | | | Second Float | | | Total | |
| Run | Total | % of | % of | Total | % of | % of | % Recovery | |
| No. | Grams | Total Pb | Total Zn | Grams | Total Pb | Total Zn | Pb | Zn |
| 1 | 82.9 | 70.40 | 25.00 | 123.9 | 10.90 | 71.60 | 81.30 | 96.60 |
| 2 | 65.4 | 63.30 | 9.82 | 150.1 | 19.30 | 87.40 | 82.60 | 97.22 |
| 3 | 84.5 | 71.10 | 29.80 | 114.2 | 10.70 | 67.40 | 81.80 | 97.20 |
| Average = | | 68.26 | 21.54 | | 13.63 | 75.47 | 81.90 | 97.00 |

EXAMPLE II

This example is a control. The procedure described in Example I was repeated with the exception that before the first float the Z-11 collector was replaced with a 40% aqueous solution of sodium n-butyl trithiocarbonate, again in a quantity of 0.1 lb/ton of ore. These results are listed in Table II where it is shown that the trithiocarbonate collector gives essentially the same results in Zn and Pb recovery as the xanthate collector.

TABLE II

| Sodium n-Butyl Trithiocarbonate as a Collector For Pb and Zn | | | | | | | | |
|---|---|---|---|---|---|---|---|---|
| | First Float | | | Second Float | | | Total | |
| Run | Total | % of | % of | Total | % of | % of | % Recovery | |
| No. | Grams | Total Pb | Total Zn | Grams | Total Pb | Total Zn | Pb | Zn |
| 1 | 88.7 | 72.90 | 31.54 | 114.5 | 9.11 | 65.56 | 82.01 | 97.10 |
| 2 | 74.4 | 72.28 | 18.46 | 124.6 | 9.36 | 78.19 | 81.64 | 96.65 |
| 3 | 87.8 | 72.03 | 31.11 | 114.2 | 9.49 | 65.99 | 81.52 | 97.10 |
| Average = | | 72.4 | 27.04 | | 9.32 | 69.91 | 81.72 | 96.95 |

EXAMPLE III

This example is the invention illustrating that when the collectors described in Example I and II are premixed and used together as a single collector the % Recovery of both Zn and Pb are maintained at the highest level reported for either of the collectors when used singularly. The procedure described in Example I was repeated with the exception that one half of the Z-11 xanthate collector was replaced with the collector from Example II, sodium n-butyl trithiocarbonate. This new collector was now 0.05 lb/ton each of the xanthate and the trithiocarbonate. The results are listed in Table III where when compared with the results listed in Table I and II it is seen that the xanthatetrithiocarbonate blend helps to maintain the highest % recovery of both Pb and Zn obtained when each collector is used separately. When compared with each collector separately, the blend appears to be most effective in the first Pb float. Here the blend increases the % Pb recovery from 72.4 to 73.8%.

TABLE III

| Sodium Isopropyl Xanthate/Sodium n-Butyl Trithiocarbonate Blend as a Collector For Pb and Zn | | | | | | | | |
|---|---|---|---|---|---|---|---|---|
| | First Float | | | Second Float | | | Total | |
| Run | Total | % of | % of | Total | % of | % of | % Recovery | |
| No. | Grams | Total Pb | Total Zn | Grams | Total Pb | Total Zn | Pb | Zn |
| 1 | 95.5 | 73.47 | 31.83 | 114.8 | 9.34 | 65.40 | 82.81 | 97.23 |
| 2 | 81.1 | 73.85 | 17.81 | 132.1 | 8.92 | 79.48 | 82.77 | 97.29 |
| 3 | 83.5 | 74.12 | 26.68 | 121.6 | 8.19 | 70.84 | 82.31 | 97.52 |
| Average = | | 73.80 | 25.44 | | 8.81 | 71.90 | 82.63 | 97.30 |

EXAMPLE IV

This example is a control using different collectors and a different ore from those described in Examples I, II and III. A copper molybdenum ore (Anamax Ore), 1030 grams was added to a ball mill along with 1.8 grams lime, 650 milliliters water and 25 mL frother (Minerec A12A, a methyl isobutyl carbinol type). In addition, 0.03 lb/ton sodium diethyl dithiophosphate (Sodium Aerofloat-American Cyanamide) was added as a collector (0.5 weight % aqueous solution). After about 7 to 10 minutes grind, the slurry was transferred to a 2.5 liter Denver D-12 flotation cell. Enough water was added to bring the fluid level to within 1 to 2 inches from the lip of the cell, usually about 30 weight % solids. The solution was conditioned for 2 minutes with stirring followed with a 6 minute float. The concentrate was dried and analyzed. The results are shown in Table IV.

TABLE IV

Sodium Diethyl Dithiophosphate as a Mo, Cu, Fe Collector in Ore Flotation

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 972 | .361 | 3.70 | 31.1 | 30.9 | .096 | 3.37 | 3.68 | 21.0 | 47.7 | 10.6 |
| 2 | 969 | .349 | 4.07 | 32.0 | 27.1 | .079 | 3.17 | 3.31 | 18.5 | 43.7 | 9.37 |
| | | | | | | | Average = | | 19.8 | 45.7 | 10.1 |

EXAMPLE V

The control example described in Example IV was repeated except the collector, sodium diethyl dithiophosphate, was replaced with sodium ethyl trithiocarbonate. The results are listed in Tabe V where when compared to the results in Table IV there is an improvement in Mo, Cu and Fe recoveries of 2.6%, 13.6% and 2.8%, respectively.

TABLE V

Sodium Ethyl Trithiocarbonate as a Mo, Cu, Fe Collector in Ore Flotation

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 977 | .322 | 2.93 | 31.3 | 23.7 | .099 | 4.18 | 4.29 | 23.5 | 58.8 | 12.1 |
| 2 | 972 | .369 | 2.81 | 31.1 | 30.6 | .101 | 4.32 | 4.71 | 21.5 | 60.6 | 13.2 |
| 3 | 980 | .372 | 2.84 | 31.4 | 29.5 | .106 | 4.31 | 4.69 | 22.2 | 57.8 | 13.0 |
| | | | | | | | Average = | | 22.4 | 59.1 | 12.8 |

EXAMPLE VI

This example is the invention and illustrates the improved recovery obtained when each of the collectors described in Examples IV and V are premixed or blended and used as a single collector. The procedure described in Example IV was again repeated except one-half of the dithiophosphate (i.e. 0.015 lb/ton ore) was replaced with 0.015 lb/ton ore of the trithiocarbonate from Example V so that the premixed blend was now 0.015 lb/ton sodium diethyl dithiophosphate and 0.015 lb/ton sodium ethyl trithiocarbonate. The results are listed in Table VI where when compared with the results in Tables IV and V it can be seen that the blend of the two collectors give improved recoveries of Mo, Cu and Fe than when either collector is used singularly.

TABLE VI

Sodium Ethyl Trithiocarbonate-Sodium Diethyl Dithiophosphate Blend as a Mo, Cu, Fe Collector in Ore Flotation

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 965 | .367 | 2.80 | 30.9 | 33.8 | .112 | 4.26 | 4.63 | 23.4 | 60.3 | 13.0 |
| 2 | 973 | .341 | 2.91 | 30.2 | 28.8 | .112 | 4.29 | 4.41 | 24.7 | 59.6 | 12.8 |
| | | | | | | | Average = | | 24.1 | 60.0 | 12.9 |

EXAMPLE VII

This example is a control using different collectors and a different ore from those described in Examples I through VI. A Mo—Fe—Cu-bearing ore (Cuprus Bagdad Mines), 900 grams, was added to a ball mill along with 2.35 grams lime, 670 milliliters water and 0.046 lb/ton of S-allyl-S'-n-butyl trithiocarbonate. After 7.5 minutes of grind, the slurry was transferred to a 2.5 liter Denver cell, 3 drops of Aerofroth 76 frother (American Cyanamid) added plus enough water such that the liquid level was about one inch from the lip of the cell (about 35 weight solids). The pH was adjusted with lime to 11.5 to 11.7 and the mixture conditioned at 1300 rpm for 2 minutes and floated for 3 minutes. After the first float, 1 more drop of frother (Aerofroth 76) was added and the float continued for three minutes. The combined concentrates were dried and analyzed. These results are listed in Table VII.

TABLE VII

S—Allyl-S'—Benzyl Trithiocarbonate as a Mo, Cu, Fe Collector

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 880 | .016 | .572 | 13.64 | 20.03 | .048 | 3.06 | 2.32 | 75.0 | 84.3 | 14.5 |
| 2 | 874 | .015 | .542 | 13.02 | 20.71 | .046 | 3.10 | 2.42 | 75.4 | 85.4 | 15.7 |
| | | | | | | | Average = | | 75.2 | 84.9 | 15.1 |

N,N-dimethyl-S-benzyl dithiocarbamate is reported in "Organic Chemistry of Bivalent Sulfur," Vol. IV by E. Emmet Reid. For the following example this compound was prepared by reacting a 40% aqueous solution of sodium dimethyl dithiocarbamate (Thiostop N, Union Carbide) with benzyl chloride in an aromatic oil, separating the water phase and steam stripping the organic phase.

EXAMPLE VIII

The control described in Example VII was repeated except the collector S-allyl-S'-n-butyl trithiocarbonate was replaced with N,N-dimethyl-S-benzyl dithiocarbamate. These results are listed in Table VIII. Compared to the results in Table VII there is a slight improvement in Fe recovery but a significant decrease in Mo recovery.

TABLE VIII

N,N—Dimethyl-S—Benzyl Dithiocarbamate as a Mo, Cu, Fe Collector

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 880 | .043 | .607 | 12.23 | 21.88 | .035 | 2.87 | 2.36 | 44.9 | 83.3 | 16.2 |
| 2 | 878 | .025 | .527 | 12.99 | 23.30 | .037 | 3.10 | 2.66 | 59.7 | 85.5 | 17.0 |
| | | | | | | | Average = | | 52.3 | 84.4 | 16.6 |

EXAMPLE IX

This example is the invention and illustrates the improved recovery of Fe and Cu when the collectors described in Examples VII and VIII were combined. The procedure described in Example VIII was repeated except that one-half of the dithiocarbamate collector used was replaced with allyl n-butyl trithiocarobnate. The results are listed in Table IX. Compared with the results in Table VII and VIII it can be seen that an improvement in Fe and Cu recoveries can be realized with the described blend.

TABLE IX

A 50:50 Wt. Ratio Blend of S—Allyl-S'—n-Butyl Trithiocarbonate:N,N—Dimethyl-S—Benzyl-Dithiocarbamate as a Mo, Fe, Cu Collector

| Run | Tails, grams | | | | Concentrate, grams | | | | % Recovery | | |
|---|---|---|---|---|---|---|---|---|---|---|---|
| No. | Sample | Mo | Cu | Fe | Sample | Mo | Cu | Fe | Mo | Cu | Fe |
| 1 | 877 | .018 | .517 | 12.72 | 22.65 | .048 | 3.24 | 2.67 | 72.7 | 86.2 | 17.3 |
| 2 | 879 | .017 | .519 | 10.81 | 21.62 | .043 | 3.32 | 2.68 | 71.7 | 86.5 | 19.9 |
| | | | | | | | Average = | | 72.2 | 86.4 | 18.6 |

SUMMARY

The date herein disclosed is summarized in Table X where it is shown that the mineral collecting efficiency of S-allyl-S'-n-butyl trithiocarbonate is enhanced when the trithiocarbonate is premixed or blended with another known collector N,N-dimethyl-S-benzyl dithiocarbamate. These results are shown in Table X.

TABLE X

Summary - Ore Flotation

| Example No. | Collector | % Recovery Mo | Cu | Fe |
|---|---|---|---|---|
| Control: | | | | |
| VII | .046 lbs/ton S—allyl-S'—n-butyl trithiocarbonate | 75.2 | 84.9 | 15.1 |
| VIII | .048 lbs/ton N,N—dimethyl-S—benzyl dithiocarbamate | 52.3 | 84.4 | 16.6 |
| Invention: | | | | |
| IX | .024 lbs/ton S—allyl-S'—n-butyl trithiocarbonate plus .024 lbs/ton N,N—dimethyl-S—benzyl dithiocarbamate | 72.2 | 86.4 | 18.6 |

Reasonable variations and modifications which will become apparent to those skilled in the art can be made in this invention without departing from the spirit and scope thereof.

What is claimed is:

1. An ore flotation process comprising (a) mixing a mineral material comprising molybdenum containing ore, water and a composition containing the following compounds
(aa) sodium diethyl dithiophosphate
(bb) sodium ethyl trithiocarbonate in a weight ratio of compound (aa) to compound (bb) in the range of 9:1 to 1.9 to establish a pump,
(b) aerating said pulp to produce a froth and a tail product,
(c) separating said froth and said tail product, and
(d) recovering molybdenum containing mineral values from said froth.

* * * * *

UNITED STATES PATENT AND TRADEMARK OFFICE

CERTIFICATE OF CORRECTION

PATENT NO. : 4,462,898

DATED : July 31, 1984

INVENTOR(S) : Robert M. Parlman, Clarence R. Bresson

It is certified that error appears in the above-identified patent and that said Letters Patent is hereby corrected as shown below:

Column 10, line 48 (Claim 1, line 8), "1.9" should be --- 1:9 ---.

Signed and Sealed this

*First* Day of *January 1985*

[SEAL]

*Attest:*

GERALD J. MOSSINGHOFF

*Attesting Officer*

*Commissioner of Patents and Trademarks*